US006637673B1

(12) United States Patent
Zur et al.

(10) Patent No.: US 6,637,673 B1
(45) Date of Patent: Oct. 28, 2003

(54) LIQUID ATOMIZER

(75) Inventors: Yoel Zur, Korazim (IL); Gandin Vitaly, Qiriat Shmone (IL); Zohar Katzman, Haifa (IL); David De Vires, Herzeliya (IL)

(73) Assignee: Dan Mamtirim, Kibbutz Dan (IL)

( * ) Notice: Subject to any disclaimer, the term of this patent is extended or adjusted under 35 U.S.C. 154(b) by 0 days.

(21) Appl. No.: 09/722,388

(22) Filed: Nov. 28, 2000

(30) Foreign Application Priority Data

Nov. 30, 1999 (IL) ..... 133226

(51) Int. Cl.[7] ..... B05B 1/34; B05B 1/14; B05B 7/10

(52) U.S. Cl. ..... 239/463; 239/466; 239/486; 239/554; 239/402

(58) Field of Search ..... 239/463, 486, 239/487, 489, 490, 492, 548, 554, 399, 402, 406; 222/321.2, 321.3, 321.7, 321.9, 137

(56) References Cited

U.S. PATENT DOCUMENTS

| | | | | | |
|---|---|---|---|---|---|
| 580,151 | A | * | 4/1897 | Barnard | 239/486 |
| 1,485,143 | A | * | 2/1924 | Mobley | 239/486 |
| 1,786,844 | A | * | 12/1930 | Hesselman | 239/533.9 |
| 2,733,103 | A | * | 1/1956 | Laster, Sr. et al. | 239/486 |
| 2,989,251 | A | | 6/1961 | Focht et al. | |
| 3,326,473 | A | * | 6/1967 | Wahlin | 239/487 |
| 3,337,135 | A | * | 8/1967 | Blakely et al. | 239/487 |
| 3,911,858 | A | * | 10/1975 | Goodwin | 239/589.1 |
| 4,389,003 | A | * | 6/1983 | Meshberg | 222/321 |
| 4,584,147 | A | | 4/1986 | Stehning | |
| 4,970,865 | A | * | 11/1990 | Shekelton et al. | 239/533.9 |

FOREIGN PATENT DOCUMENTS

| | | | | |
|---|---|---|---|---|
| DE | 473 136 C | | 3/1929 | |
| DE | 10 10 466 B | | 6/1957 | |
| JP | 403081428 A | * | 4/1991 | 239/486 |

* cited by examiner

*Primary Examiner*—Davis D Hwu
(74) *Attorney, Agent, or Firm*—Browdy & Neimark

(57) ABSTRACT

A liquid atomizer comprising a housing fitted with an inlet for connecting to a liquid supply line and a cavity being in flow communication with the inlet and having a longitudinal axis. The housing has one or more outlet nozzles for emitting atomized liquid. A vortex generating member is received within the housing and is formed with at lest one vortex generating path generates a liquid vortex about an axis transversally extending relative to the longitudinal axis of the housing and extending opposite a respective outlet nozzle. Each of the vortex generating paths is in flow communication with the cavity and extends opposite a respective outlet nozzle.

7 Claims, 13 Drawing Sheets

LIQUID ATOMIZER

FIELD OF THE INVENTION

The present invention is generally in the field of liquid atomizers and in particular it is concerned with atomizers for agricultural and domestic use.

The term "atomizer" as used herein in the specification and claims refers collectively to a device capable of emitting a fine mist of liquid. Such devices are often referred to in the art also as foggers, sprayers, mist devices, humidifiers, etc.

BACKGROUND OF THE INVENTION

Atomizers used in agriculture and for domestic purposes serve for conditioning the environment both by increasing humidity such as in greenhouses and tropical gardens, for irrigation and for cooling. A variety of atomizers are known, referred to as rotary-cup atomizers, air blast/air assist etc. The present invention is concerned with pressure atomizers.

Cooling by atomized liquid is obtained by forcing a liquid, typically water, through specially designed nozzles so as to obtain a fog of ultra fine water droplets. The liquid droplets absorb heat energy of the environment and evaporate, whereby the energy (heat) consumed for converting the liquid into gas (vapor) is extracted from the environment, thus cooling the air.

The amount of moisture in the air divided by the maximum amount of moisture there could be absorbed at the same temperature (relative humidity) is a significant parameter in determining cooling potential. The lower the relative humidity, the more liquid can be vaporized, thus the more heat can be removed from the environment. Evaporative cooling can be used in most geographical zones owing to the fact that when temperature reaches its peak during day, relative humidity is normally at its lowest. For this reason, evaporative cooling is commonly used in many zones over the world.

Liquid atomizers are at times, used also as frost protectors by creating a mist layer above the agricultural growth, thus preventing frost from damaging the crops Pressure atomizers are commonly in use and typically comprise a housing fitted with at least one outlet nozzle, a core member associated with each nozzle for generating a vortex (often referred to in the art as "swirl")and a strainer/washer member packed together by screw coupling of the nozzle to the housing. The atomized spray is obtained by guiding a liquid jet through a path causing the jet to swirl and upon exiting through a fine outlet nozzle, an atomized spray is emitted.

Typically, each outlet nozzle is associated with a single housing and where covering a large area with mist is required, thus several such housing may be mounted on a splitting element, each such outlet nozzle being directed to a different direction and said splitting element being connected in turn to a liquid supply line.

It is an object of the present invention to provide a novel and improved liquid atomizer. The number of components, by one of its preferred embodiments, being reduced as compared with prior art such devices.

SUMMARY OF THE INVENTION

The present invention provides a liquid atomizer for use in agriculture and for domestic us and is aimed, by one of its preferred embodiments, at providing an atomizer comprising a reduced number of components. The liquid atomizer comprises a housing fitted with an inlet for connecting to a liquid supply line and a cavity being in flow communication with the inlet, said cavity having a longitudinal axis; a peripheral member formed with at least one outlet nozzle for emitting atomized liquid; and a vortex generating member formed with a vortex generating path being in flow communication with the cavity and extending opposite a respective outlet nozzle; each vortex generating path generates a liquid vortex about an axis transversally extending relative to the longitudinal axis of the housing.

According to one embodiment, wherein the peripheral member is integral with housing and where the vortex generating member is sealingly received within the cavity of the housing. According to another embodiment, the vortex generating member is integral with the housing and the peripheral member is mounted over the vortex generating member.

In accordance with another embodiment, the vortex generating member is coaxial with the housing and is sealingly received therewithin. By one embodiment it is radially fixable within the housing.

Typically one or more outlet nozzles are circular. However, they may also be or otherwise shaped nozzles so as to distribute a selected fog pattern.

By one preferred arrangement, the housing and the vortex generating member are cylindrical, wherein the vortex generating member is snapingly fixed to the housing and may be displaced into other functional positions. In accordance with a preferred design of this an arrangement, peripheral walls of the vortex generating member sealingly bear against inner walls of the housing, thus preventing liquid flow between the walls of the vortex generating member and the housing. However, a sealing member may be introduced between the vortex generating member and the housing.

In accordance with one specific and preferred embodiment, the vortex generating path generates a liquid vortex about an axis substantially perpendicular to the longitudinal axis of the housing.

In accordance with one arrangement of the invention, the vortex generating path has an inlet extending parallel to the longitudinal axis and originating at an edge of the vortex generating member. In accordance with another design, the vortex generating member has a hollow being in flow communication with the cavity and the vortex generating path has an outlet originating from the hollow. This arrangement is in particular suitable for including a sealing member between the vortex generating member and the housing.

In accordance with one arrangement, the vortex generating path has an R or P like cross-section with the center of the round portion extending opposite the respective outlet nozzle and wherein the respective leg portions of the R and P like shapes constitute the opening of the path. In accordance with a second arrangement, the vortex generating path has a cochlea-like (spiral) cross-section with the center thereof extending opposite the respective outlet nozzle.

According to a variation of the above embodiments, the vortex generating path is formed with two (or more) leg portions for increasing the flow rate, the leg portions extending from an edge of the vortex generating member which is in flow communication with the cavity, or have at least one leg being in flow communication with the cavity via a hollow formed in the vortex generating member which is in flow communication with the cavity.

In accordance with another variation of the invention, the vortex generating member comprises a plurality of vortex generating paths and the housing comprises a plurality of outlet nozzles; the vortex generating paths and the outlet nozzles being distributed at different angular divisions; the vortex generating member is fixable within the housing at different radial positions, each giving rise to cooperation of different outlet nozzles with respective vortex generating paths and to sealing of other outlet nozzles. This arrangement enables to determine the number of active nozzles within a single housing, allowing to increase or decrease the number of active nozzles so as to obtain different sectorial coverage of mist.

By another design, some of tie vortex generating paths of the vortex generating member are axially offset and some of the outlet nozzles of the housing are offset in a corresponding manner, whereby axial or angular displacement of the vortex generating member with respect to the housing entails engagement of a different vortex path with a different outlet nozzle. In this way it is possible to select different fog patterns, outlet rate, etc. By a modification thereof, at least one outlet nozzle and at least one vortex generating member are axially offset.

The housing and vortex generating member are fitted with corresponding mating members for setting the vortex generating member at the different radial positions within the housing.

The arrangement of the liquid atomizer in accordance with the present invention reduces to minimum the number of components wherein each housing is fitted with a single vortex generating member whereby a single housing is required or several outlet nozzles.

By a different application of the invention, the inlet is in flow communication with a pressure threshold valve received before or after the inlet. By a preferred embodiment, the pressure threshold valve is received within the cavity of the liquid atomizer. In accordance with one such design, the pressure threshold valve comprises a closure member biased against the inlet of the housing.

In accordance with another embodiment, the pressure threshold valve is a leakage preventing device (LPD), and wherein the closure member is spring biased against the inlet of the housing and has a piston rod connecting it with a piston, said piston being displaceable along a corresponding cylinder and is in flow communication with the cavity. The LPD arrangement provides for opening of hie closure member at a predetermined pressure threshold wherein the inlet is rapidly opened into a maximal open stage. This may be obtained by a structure in which the piston is sealingly displaceable within the cylinder and wherein liquid entering the cavity applies force on the piston in a direction entailing displacement of the closure member away from the inlet.

In accordance with such an embodiment, it is desired that the cylinder is vented to the atmosphere. In accordance with a modification of the invention, the piston is displaceable against a membrane fitted at an end of the cylinder.

BRIEF DESCRIPTION OF THE DRAWINGS

For better understanding, the invention will now be described, in a non-limiting example only, by way of example only, with reference to some accompanying drawings, in which.

DETAILED DESCRIPTION OF SPECIFIC EMBODIMENTS

Figure 1A:
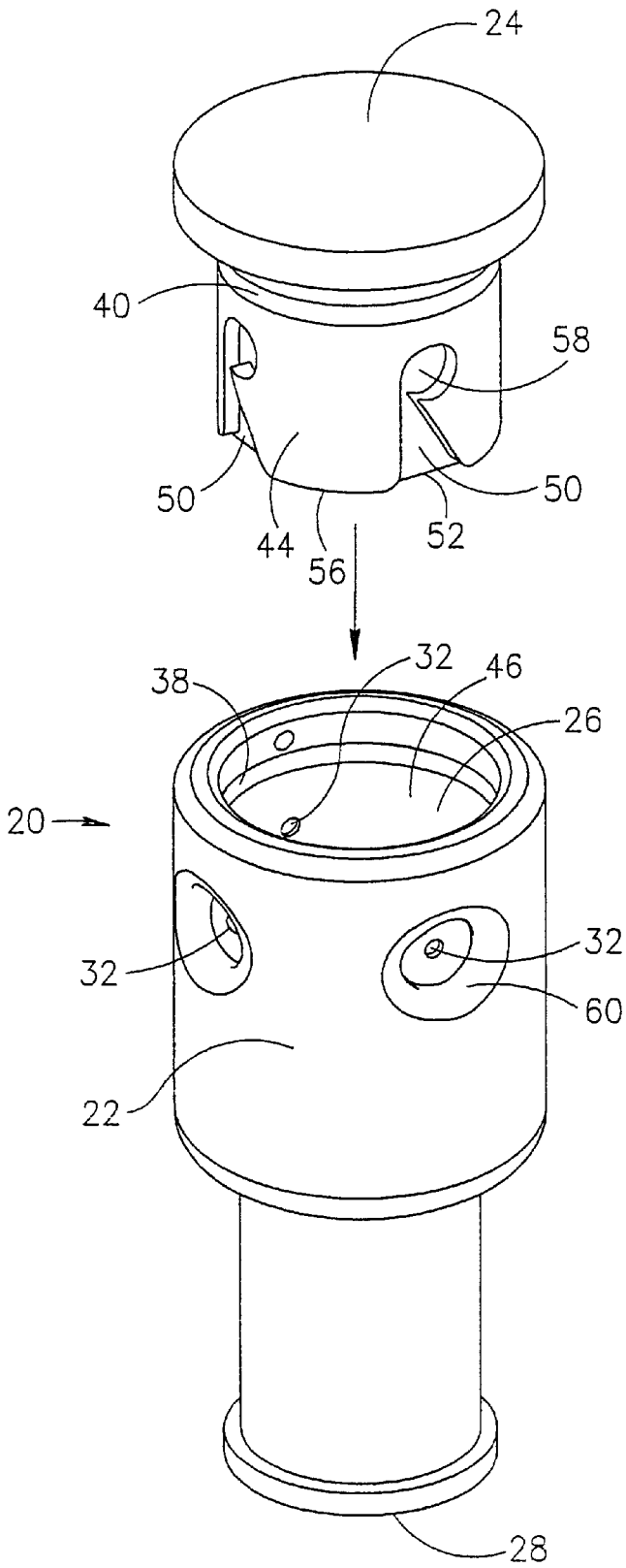
FIG. 1A is an exploded isometric view illustrating the atomizer of the present invention, with two optional replacement fog generating members.

Attention is first directed to FIG. 1 of the drawings illustrating an atomizer generally designated 20 consisting of two principle components, namely a housing 22 and a vortex generating member 24. Housing 22 is cylindrical and comprises a cylindrical cavity 26 being in flow communication with an inlet 28 which may be attached by known means (press fit, screw threading, etc.) to a water supply line (not shown). It is clear that a cylindrical housing is only an example and any other shape is possible too.

Radially extending from the cavity 26 there are four outlet nozzles 32 (only three seen) extending from the cavity 26 to an external surface of the housing 22. As can further be seen in FIG. 1A, the housing is fitted adjacent an upper edge thereof with an annular groove 38 for snapping and sealingly receiving a corresponding annular rim 40 formed at the vortex generating member 24. If required, a suitable O-ring may be provided within a suitable groove.

The vortex generating member 24 is a plug-like member having a cylindric portion 44 adapted for tight and sealing engagement within the walls 46 of cavity 26 of the housing 22 essentially not leaving an interstice between the mating surfaces whereby liquid cannot flow between wall 46 and the cylindric portion 44 of the vortex generating member 24.

Vortex generating member 24 is fitted, in the present example, with four vortex generating paths 50 (two seen in FIG. 1A) each having an R-like cross-section with an inlet portion 52 extending between the legs of the R-like shape at an edge 56 of the cylindric portion 44 with the center of the R-like portion 58 extending essentially opposite an opening of a corresponding nozzle 32 formed in the housing 22.

Figure 2:
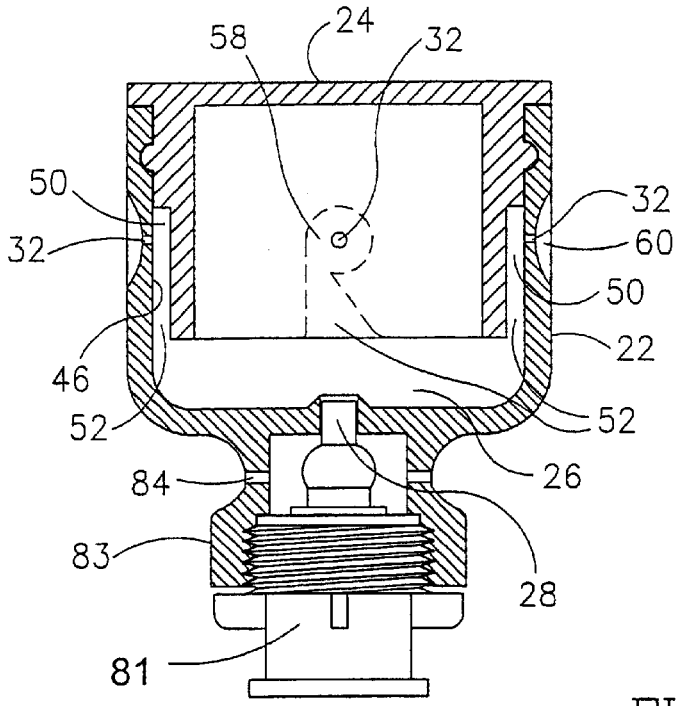
FIG. 2 is a longitudinal sectional view of a device in accordance with the present invention fitted with a leakage preventing device.

In the assembled position, which can be seen in cross-section in FIG. 2, water enters the cavity 26 through the inlets 28 and is then forced to flow into the vortex generating paths 50 extending between the wall 46 of the cavity 26 and the path 50, whereby the water enters through the widened inlet portion 52, forced to spin within the round portion 58 and exits through the narrow outlet nozzle 32 after it is swirled, so as to emit a fine spray of atomized liquid.

It is noticed tat the housing 22 is formed around the outlet nozzles 32 with a reflector-like indentation 60 in order not to interfere with the atomized water.

It will further be appreciated that the vortex generating member 24 is sealingly received within the housing 22 in a tight manner and in a manner in which it is angularly fixed therewithin, to ensure that the vortex generated at the round portion 58 of vortex generating portion 50 is axially aligned with the outlet nozzle 32 of the housing 22. This may be, for example, by providing suitable projections and corresponding receiving recesses.

Figure 1B:
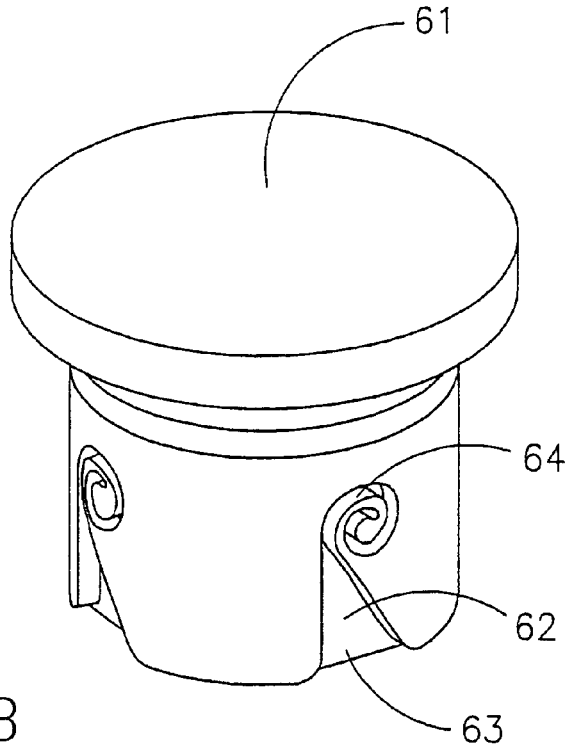
FIGS. 1B to 1E illustrate different embodiments of vortex generating members.

FIG. 1B, there is illustrated a vortex generating member 61 which is similar to vortex generating member 24 in FIG. 1A, the different residing in the vortex generating path 62 which has an opening portion 63 similar to opening portion 52 and terminates at a cochlea-like pattern 64, ending opposite an outlet nozzle when assembled within a housing of the atomizer.

Figure 1C:
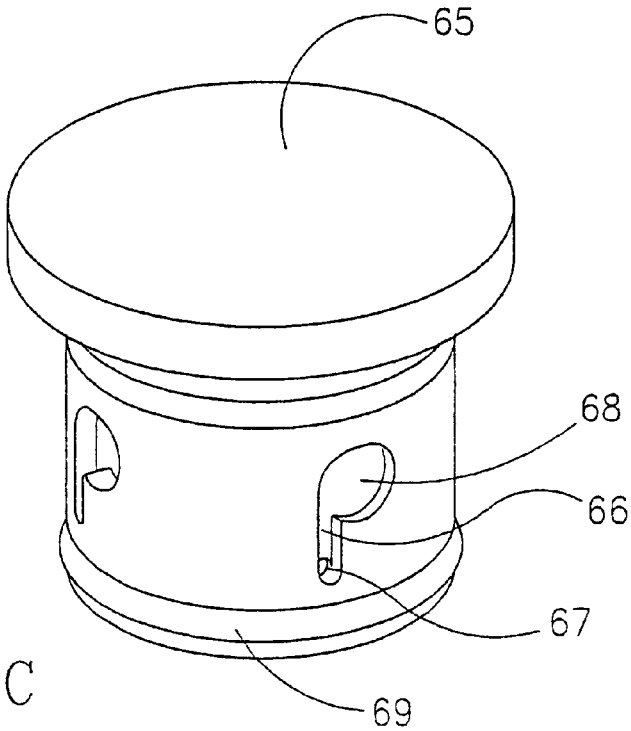

FIG. 1C is still a different embodiment of a vortex generating member 65, having a P-like vortex generating path 66 formed with a bore 67 extending from a hollow of the vortex generating member (which is in flow communication with the cavity of the housing). The path 66 has a round vortex generating portion 68 as explained in connection with FIG. 1A. The arrangement in accordance with the embodiment of FIG. 1C is that a suitable sealing member, e.g. an O-ring 69, may be provided between the housing and the vortex generating member for improved sealing therebetween.

Figure 1D:
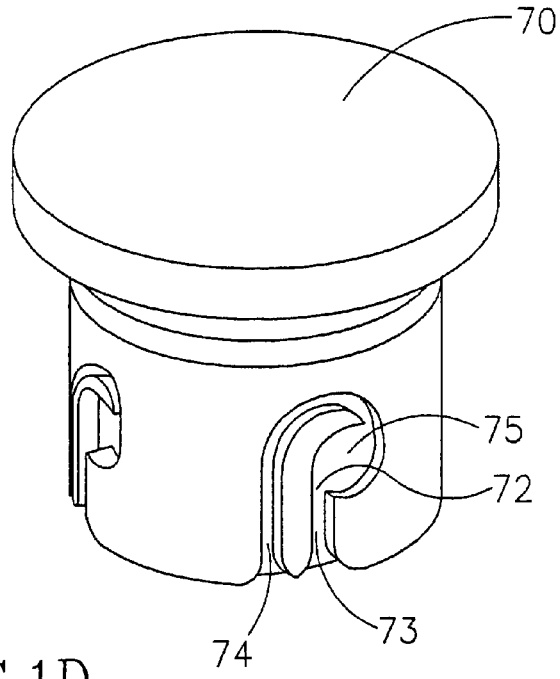

FIGS. 1D and 3E illustrate modifications of the vortex generating member. In FIG. 1D the vortex generating member 70 is formed with vortex generating paths 72 having two inlet ducts 73 and 74 both extending from a bottom edge of the member 70 into a circular shaped well 75. This arrangement is useful for increasing flow rate.

The vortex generating member 76 (FIG. 1E) has a circular well portion 77 into which extend one inlet duct 78 extending from a bottom edge (as in, FIG. 1D) and a second inlet duct 79 formed with an bore 80 (as in FIG. 1C).

As can further be noticed in die embodiment of FIG. 2, an inlet portion 83 of the housing 22 has venting openings 84 and is screw-fitted with a leakage preventing device (LPD) 81 of a known type, available on the market. The purpose of such an LPD device is to prevent leakage of water from the atomizer by ensuring that water flow into the device is enabled only upon a minimal pressure at the liquid supply line. However, as long as the pressure remains below the predetermined pressure, the LPD device remains closed blocking water flow into the atomizer. Still another feature of tie LPD is that once it opens to permit flow into the atomizer, it is filly opened, namely it rapidly displaces between its open and closed position.

Figure 3:
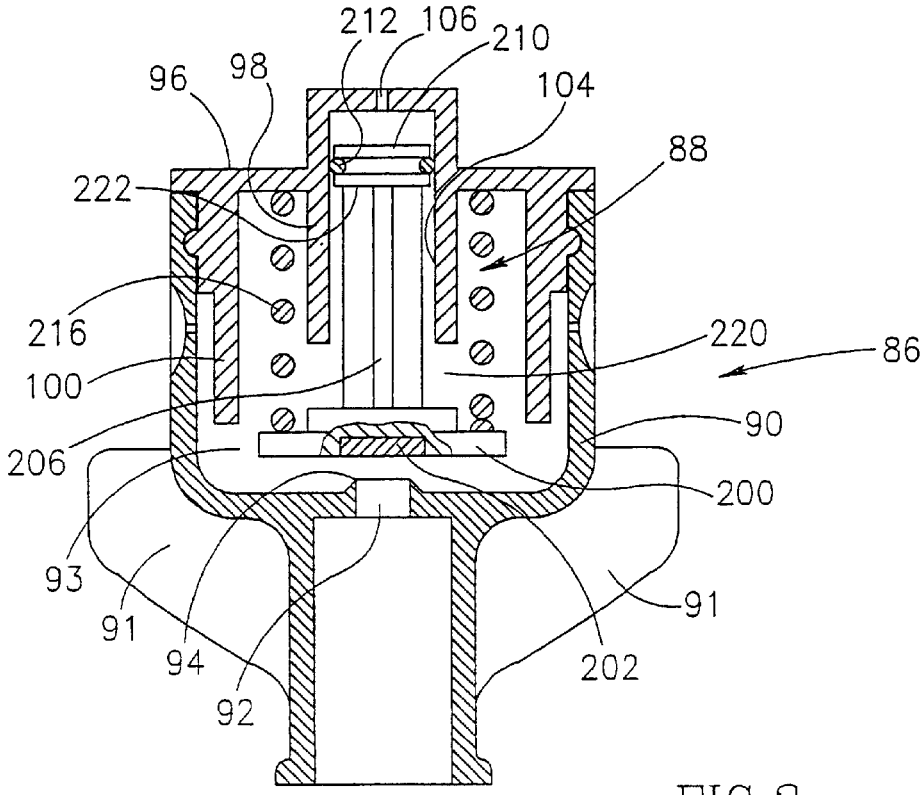
FIG. 3 is a longitudinal sectional view of an atomizer in accordance with the invention integrally fitted with a leakage preventing device.

In the embodiment of FIG. 3, the liquid atomizer 86 is substantially similar to the previous embodiments with the exception that it comprises an integral TPD 88. The housing 90 is fitted with two side flaps 91 to facilitate fit connection with a fluid supply line (not shown). The inlet 92 into the cavity 93 has an upwardly projecting rim 94 for sealing engagement with a closure member, as will become apparent hereinafter.

The vortex generating member 96 comprises an annular wall 98 coaxial and parallel with cylindric wall 100, forming a cylinder 104 vented by means of venting aperture 106. A closure plate 200 is formed with a sealing portion 202 opposite the rim 94 of inlet 92 and is typically made of a resilient material for improved sealing thereof. Extending from an opposite face thereof there is a piston rod 206 fitted at its opposite end with a piston 210 sealingly displaceable within cylinder 104 by means of O-ring 212. The closure member 200 is normally biased into sealing engagement of inlet 88 by means of a coiled spring 216 bearing at one end against closure member 200 and at an opposed end against a wall of the vortex generating member 96.

The arrangement in accordance with the embodiment of FIG. 3 is such that as long as the water pressure within the supply line (not shown) does not exceed a minimal predetermined pressure, then the closure member 200 remains in its closed position, namely, sealing inlet 92. However, as the water pressure within the supply line exceeds the predetermined pressure threshold to a pressure exceeding the biasing force of a spring 216, the closure member 200 displaces away from the rim 94 thereby opening inlet 92, whereby water entering the cavity 220 enters into the cylinder 104 applying additional force on a bottom surface 222 of piston 210 assisting the displacement of the closure member 200 from the inlet. Disengagement from the rim 94 i.e. opening of the inlet 92 is rapid since the piston 210 is exposed to atmospheric pressure via aperture 106. When, however, the liquid pressure drops below the predetermined pressure threshold the closure member 200 sealingly engages the rim 92 of inlet 92 preventing further flow of water into the cavity 220.

Figure 4:
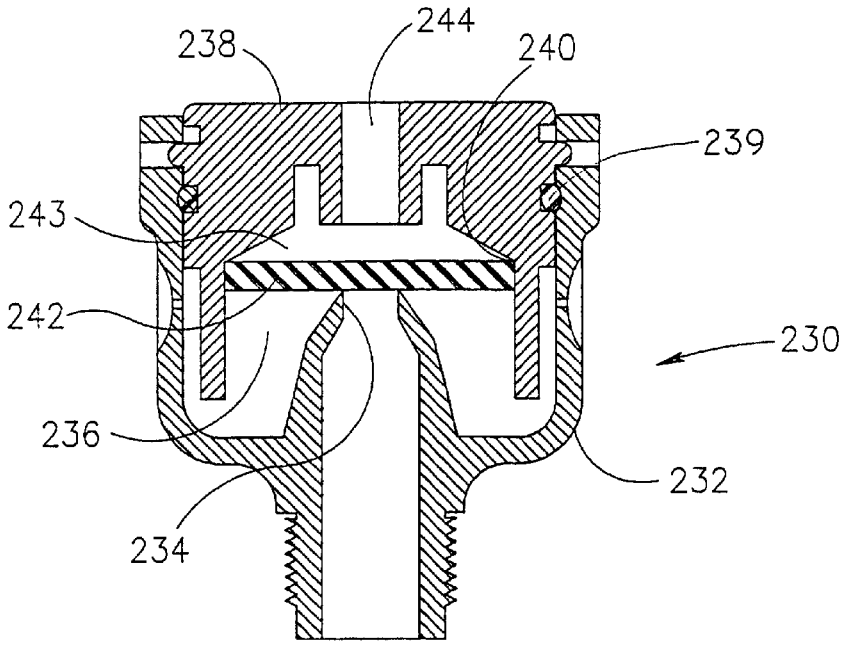
FIG. 4 is a different embodiment of a liquid atomizer in accordance with the invention fitted with still a different leaking preventing device.

In FIG. 4, there is illustrated still another embodiment of a liquid atomizer 230 differing from the previous embodiments mainly in the design of the leaking preventing device. Housing 232, in the present example is fitted with an external threading for connecting to a liquid supply line (not shown) and is formed with an inlet 234 extending into cavity 236. The vortex generating member 238 is formed with a shoulder 240. In the assembled position there is a flexible closure member 242 sealingly bearing against the inlet 234 and being pliable, upon pressure rise of fluid at the inlet side thereof, to disengage the inlet 234 allowing liquid to flow into the cavity 236 whereupon liquid pressure is applied on an increased area of the closure member 242 assisting its further deformation into disengagement from the inlet 234. However, upon pressure drop of the fluid ingressing the cavity 236, the closure member 242 retains its original position in which it sealingly bears against the inlet 234. A space 243 at an opposite side of the closure member 242 is vented by means of opening 244 to allow fast deformation of the closure member.

In this embodiment there is provided an O-ring 239 sealing between the housing 232 and the vortex generating member 238.

According to a modification of the embodiment of FIG. 4, there is provided a spring (not shown) for biasing the closure member 242, at a predetermined force, towards the inlet opening of inlet 234.

Figure 5:
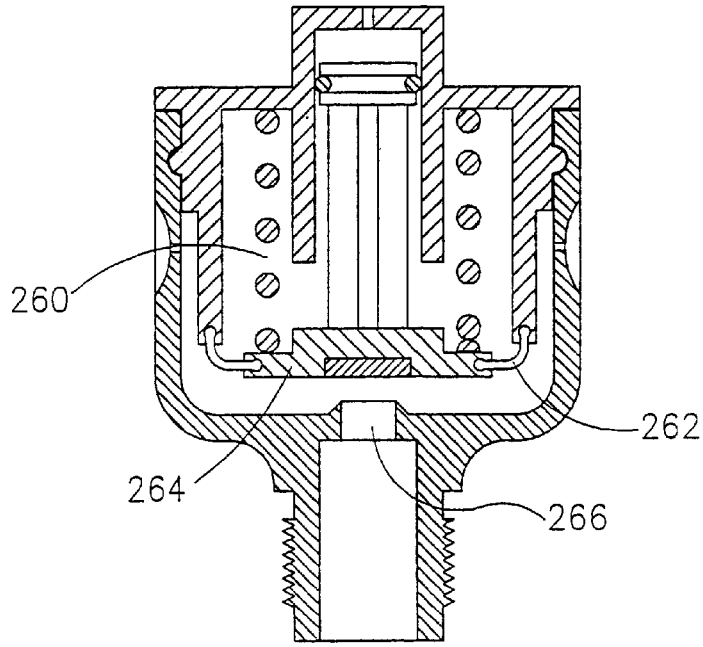
FIG. 5 is a longitudinal section of an atomizer in accordance with the present invention integrally fitted with a pressure threshold valve.

The embodiment of FIG. 5 resembles in a way the embodiment of FIG. 3. However, the space 260 is scaled by a flexible diaphragm 262 preventing ingress of water into the confined space 260 whereby a pressure threshold valve is obtained, namely the closure member 264 remains in a sealing position against inlet 266 as long as the liquid inlet pressure does not reach a minimal predetermined threshold level and then only it begins to displace away from the inlet in correlation with the pressure change, namely, at a low pressure threshold the closure member 264 will only slightly displace whereas at the more significant pressure threshold the closure member will displace accordingly.

Figure 6:
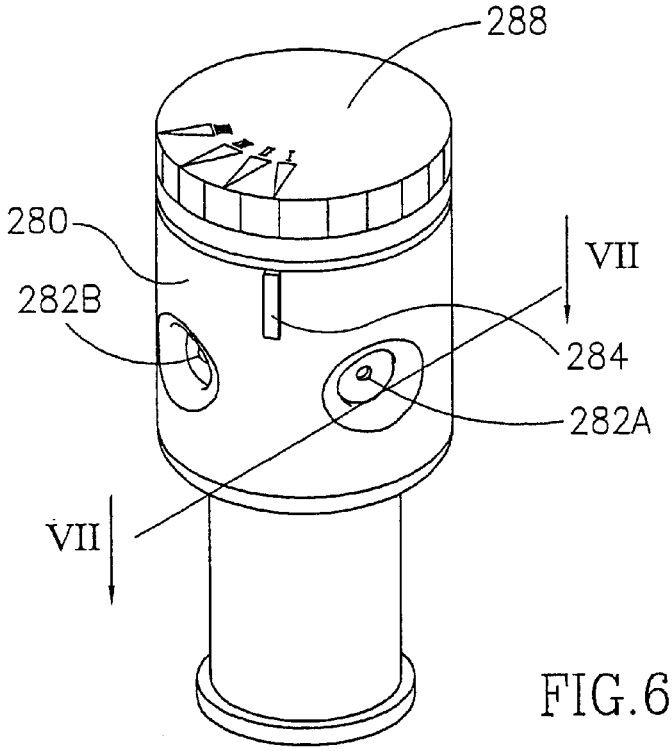
FIG. 6 is a perspective view of a sector-adjustable atomizer in accordance with the present invention.
Figure 7A:
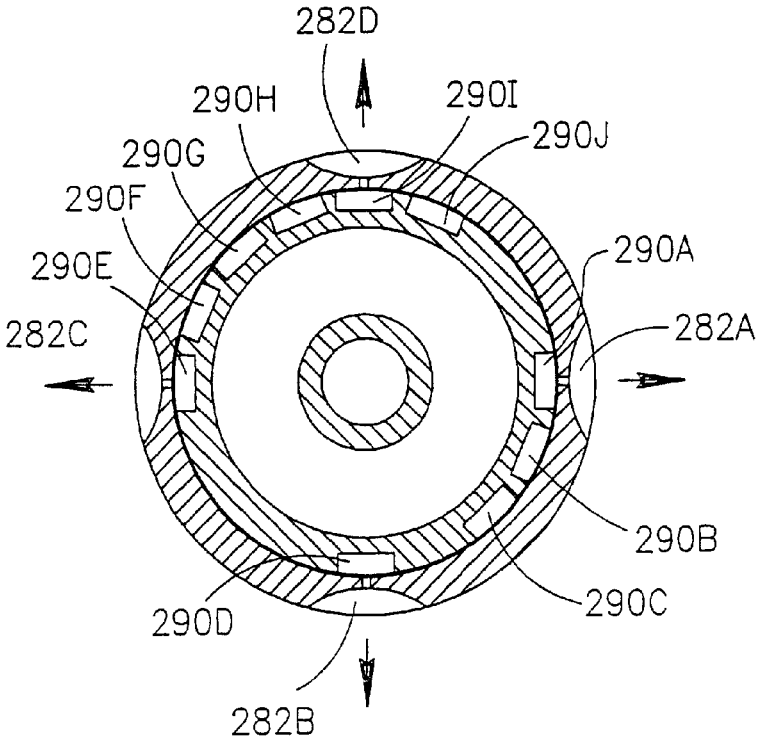
FIGS. 7A–7D are sectional views along line VII—VII in FIG. 6 in four consecutive positions emitting an atomized spray at four different sectorial positions.
Figure 7B:
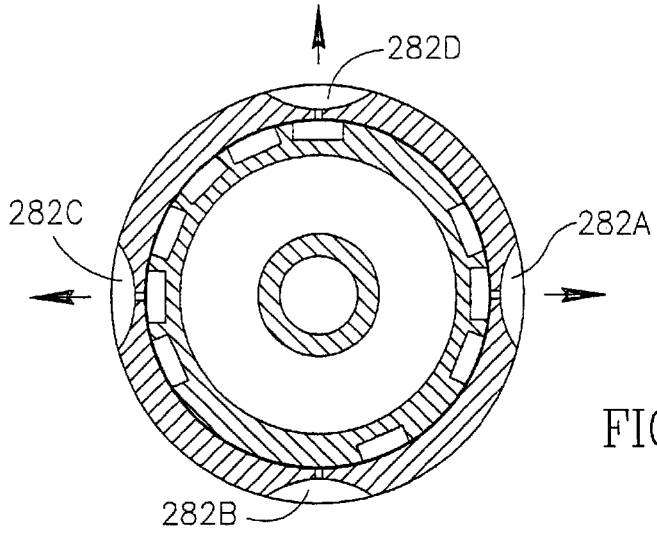
Figure 7C:
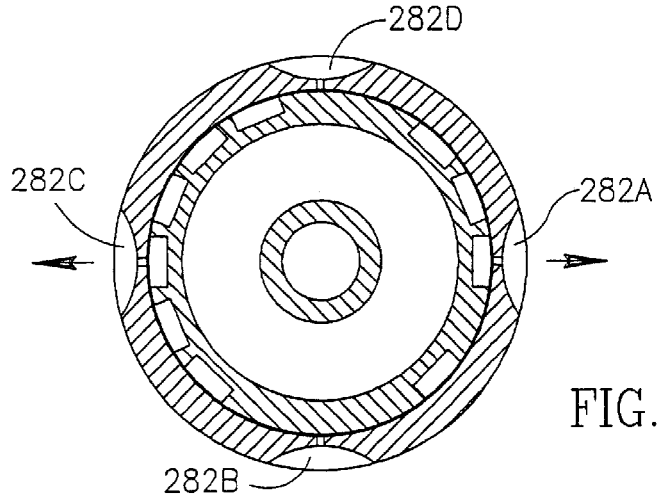
Figure 7D:
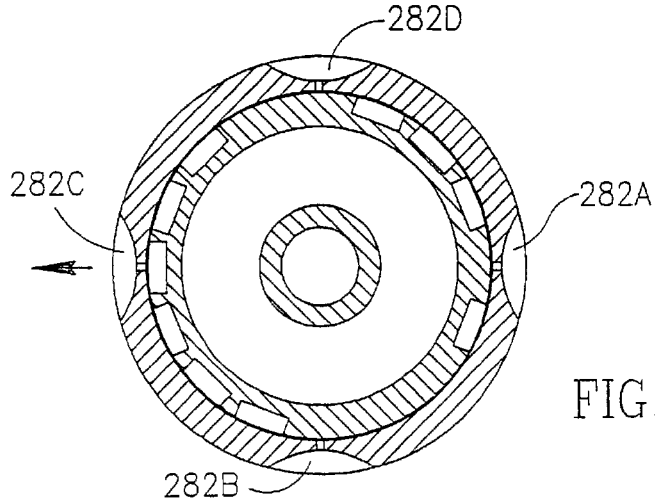

FIGS. 6 and 7 are concerned with an embodiment of the invention wherein the housing 280 is similar to the housing in accordance with two previous embodiments and comprises four outlet nozzles 282A–282D (only two seen in FIG. 6) and a visible position indicator 284. The vortex generating member 288 is formed with ten vortex generating paths indexed 290A–290J (FIGS. 7) being angularly shifted from one another in a manner which at different angular settings of the vortex generating member 288 with respect to the housing 280 an atomized spray is emitted through either one, two, three or four respective outlet nozzles of the housing, as desired. This may be obtained by rotating the vortex generating member 288 within the housing 280 such that at each time one or more of the vortex generating paths face one or more corresponding outlet nozzles of the housing.

In accordance with this embodiment the liquid atomizer may be useful for emitting the atomized spray at a variety of sectors as may be required at different settings within a hothouse, etc.

It will be, however, appreciated flat whilst in accordance with one embodiment the vortex generating member 288 is rotatable within the housing 280, in accordance with another embodiment it may be fixed within the housing and the arrangement of a plurality of vortex generating paths as illustrated in. FIGS. 7A–7D is factory set. A further embodiment may of course be such that there exist an additional position in which all the outlet nozzles are blocked, namely, no atomized jet is emitted.

Figure 8:
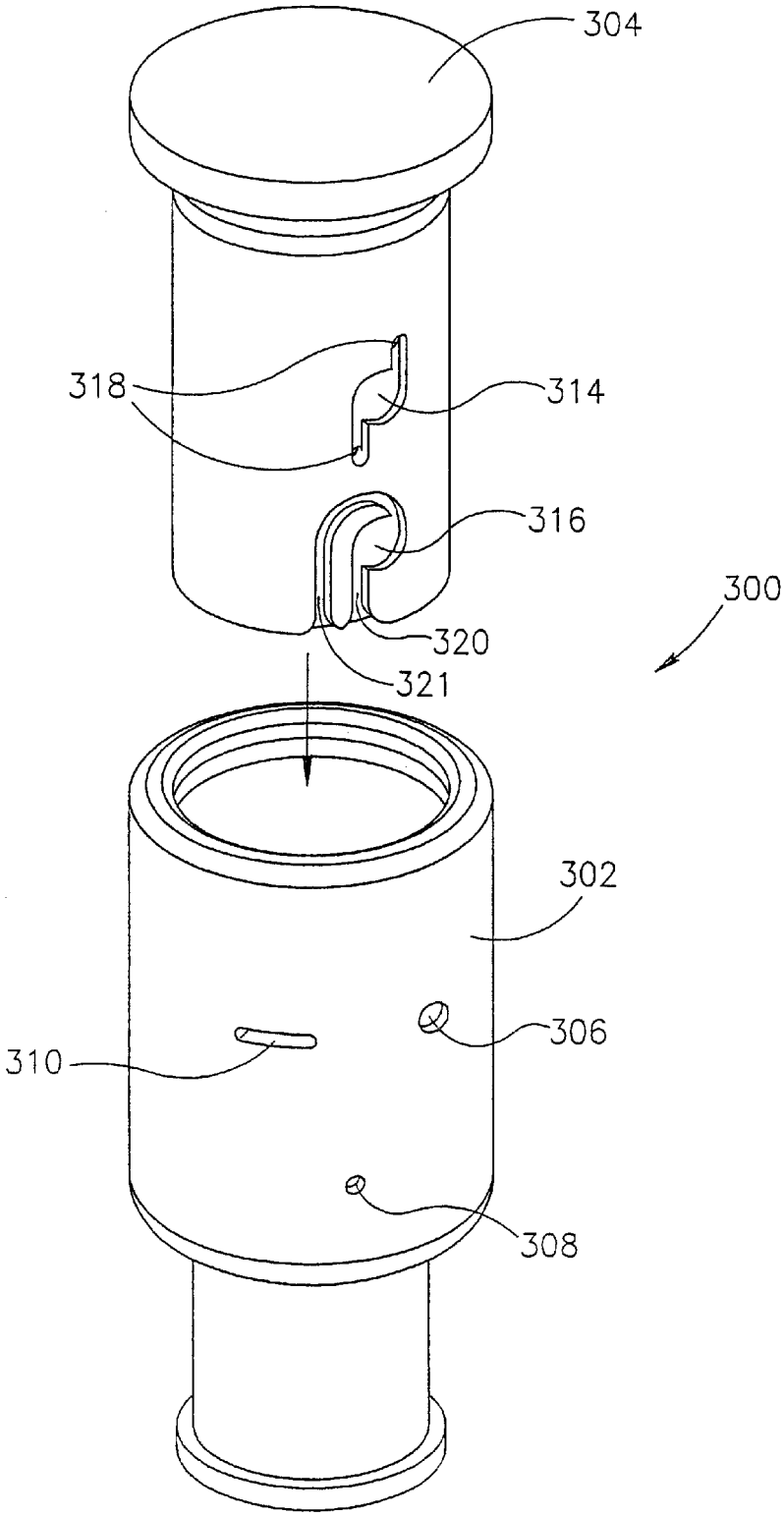
FIG. 8 is a perspective exploded view of an atomize according to still an embodiment of the invention.
Figure 9C:
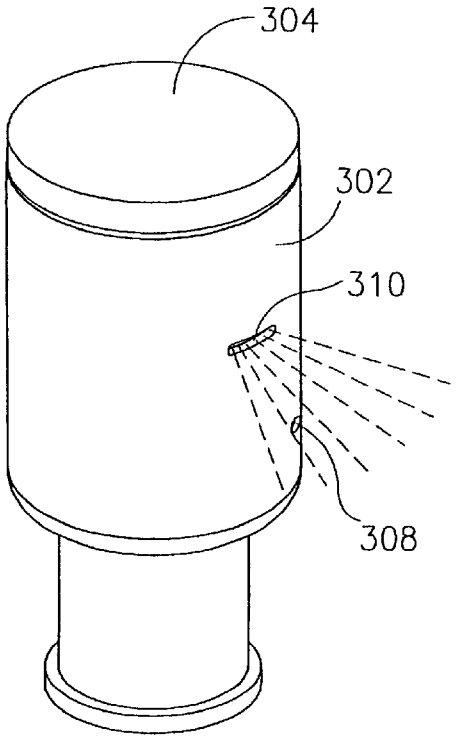
FIGS. 9A–9C are perspective views illustrating three different operative positions of the atomizer of FIG. 8.
Figure 9B:
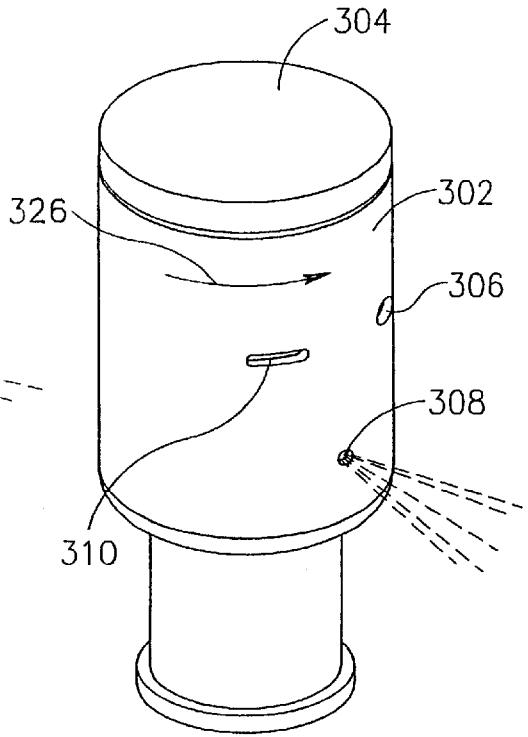

FIGS. 8 and 9 illustrate still another embodiment in which the atomizer 300 is capable of distributing the atomized liquid at different sectors, varying outflows and at different patterns. The atomizer 300 comprises a housing 302 and a mating vortex generating member 304.

Housing 302 is principally similar to previous embodiments with the exception that it comprises a plurality of outlet nozzles; 306 having a respective large diameter; 308 having a smaller diameter; and 310 having an elongate shape. It is noted that the outlet nozzles are angularly shifted and furthermore that outlet nozzles 306 and 310 are formed at essentially the same level, wherein outlet nozzle 308 is formed at a lower level.

Figure 1E:
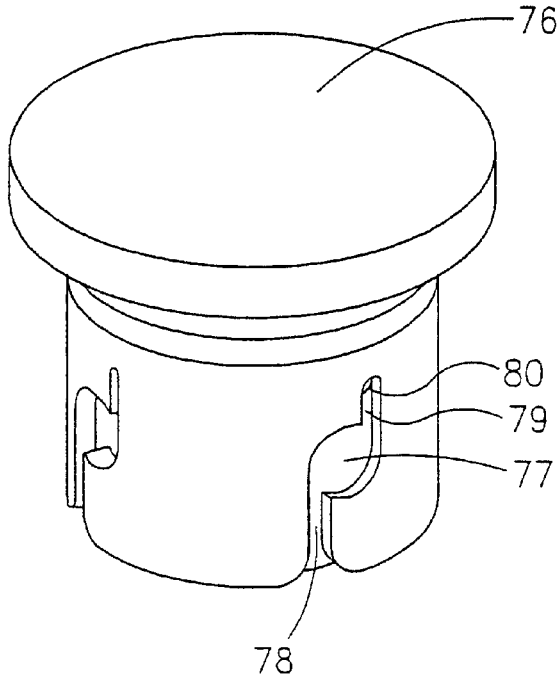

Vortex generating member 304 is formed, in the present example, with two vortex generating paths 314 and 316 axially extending above one another, where the former is in flow communication with the cavity via openings 318 and the later is in flow communication with the cavity via ducts 320 and 321, as explained hereinabove with reference to FIGS. 1C–1E.

Figure 9A:
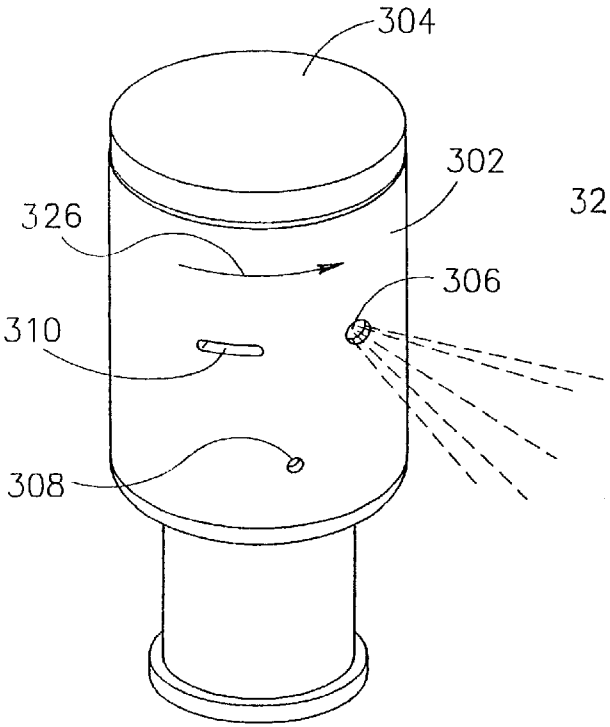

The arrangement is such that at an initial position (FIG. 9A) outlet nozzle 306 extends opposite vortex generating path 314, whilst outlet nozzles 308 and 310 are inoperable, namely do not extend opposite a corresponding vortex generating path. As seen in FIG. 9A atomized liquid is distributed at circular pattern having a large diameter. Upon rotating the housing 302 in the direction of arrow 316 (or respectively the vortex generating member 304, in a reversed direction), the outlet nozzle 308 comes t a position in which it opposite the lower vortex generating path 316, whereby a narrower circular pattern of atomized liquid is distributed. Upon further rotation of the housing in the same direction (arrow 316) the longitudinal outlet nozzle 310 comes to a position in which it is in flow communication with the vortex generating path 314, wherein the atomized liquid is emitted at a narrow, longitudinal pattern.

Figure 10:
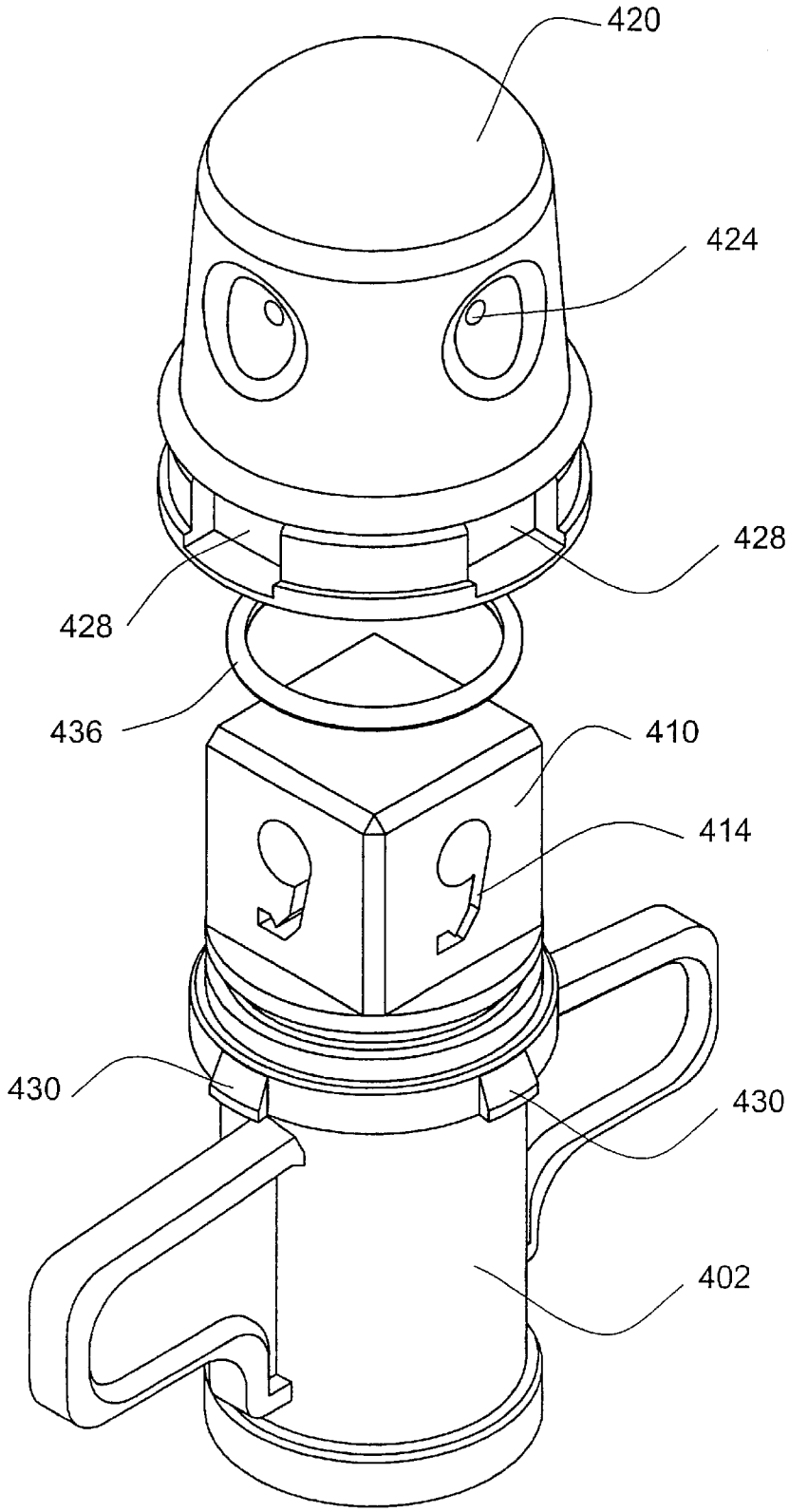
FIG. 10 is an isometric, exploded view of a further embodiment of an atomizer in accordance with the present invention.
Figure 11:
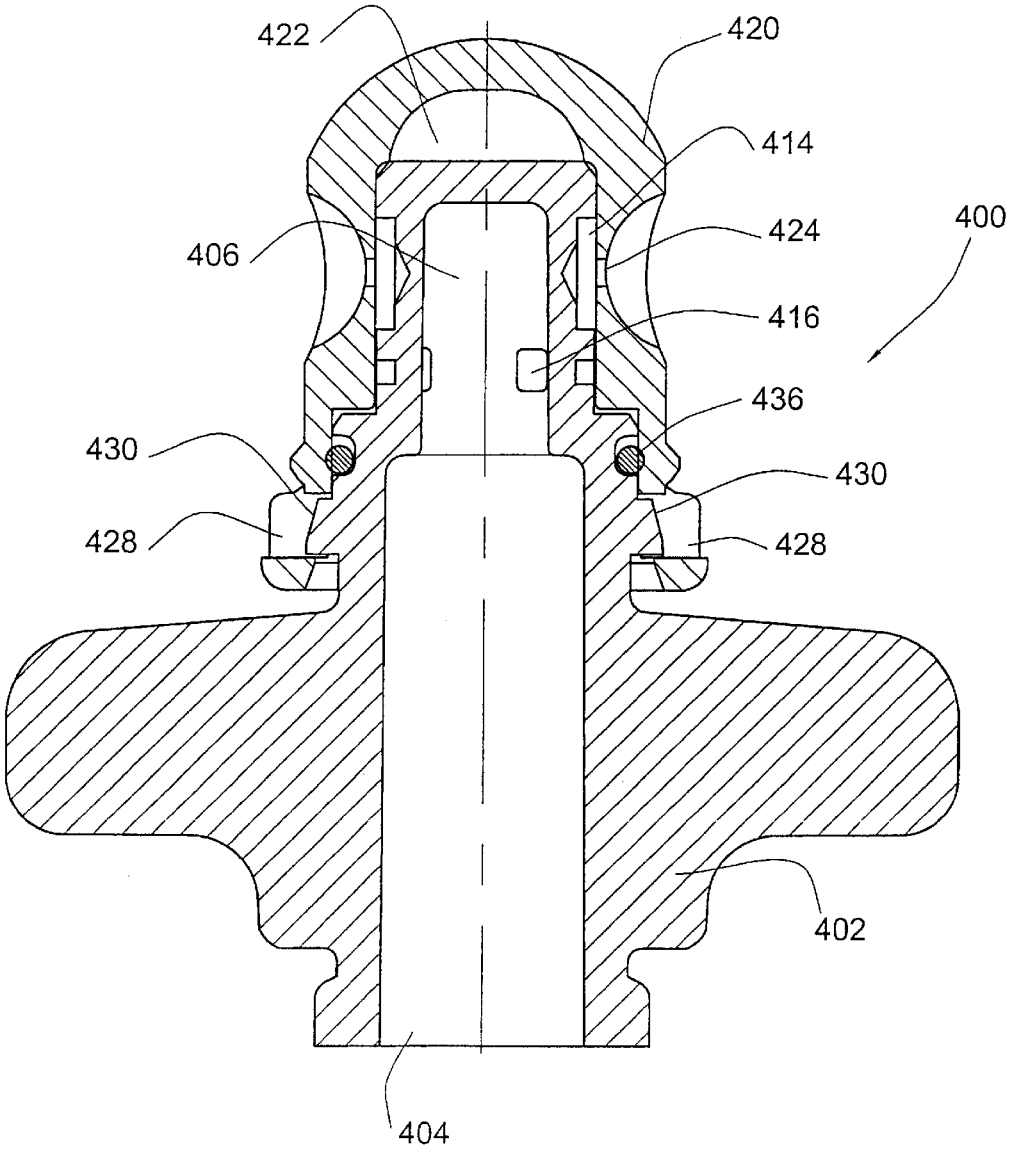
FIG. 11 is a cross-sectional view of the atomizer of FIG. 10, assembled.

FIGS. 10 and 11 illustrate a further embodiment of the fogger in accordance with the present invention generally designated 400 and comprising a housing member 402 formed with an inlet 404 extending into a cavity 406 having a rectangular cross-sectional head 410 (best seen in FIG. 10).

Head 410 is formed with four vortex generating paths 414 extending from cavity 406 through radial apertures 416 (FIG. 11), similar to the vortex generating paths disclosed in previous embodiments.

An atomizing cap 420 has a receptacle 422 snugly receiving the square head 410 whereby opposite at least one vortex generating path 414 there is formed an outlet nozzle 424, similar to the disclosure of the previous embodiments. However, it would be appreciated that the number of outlet nozzles may be lesser than the number of vortex generating paths for irrigating at a selective zone only.

Cap 420 is formed with radial recesses 428 for snapingly receiving radial projections 430 formed in housing 402 and an O-ring 436 is provided for sealing any interstice between the cap 420 and the bead 410 to prevent wetting at the surrounding of the atomizer.

In operation, water entering inlet 404 emerges through openings 416 and then flows through vortex generating paths 414 where it is vortexed and emerges than through outlet nozzles 424 in an atomized form as explained hereinbefore.

In connection with the embodiments of FIGS. 8 and 9, the artisan will appreciate that the devices may be used to distribute the atomized liquid in any distribution pattern, also distribution along the longitudinal axis of the device.

Figure 12:
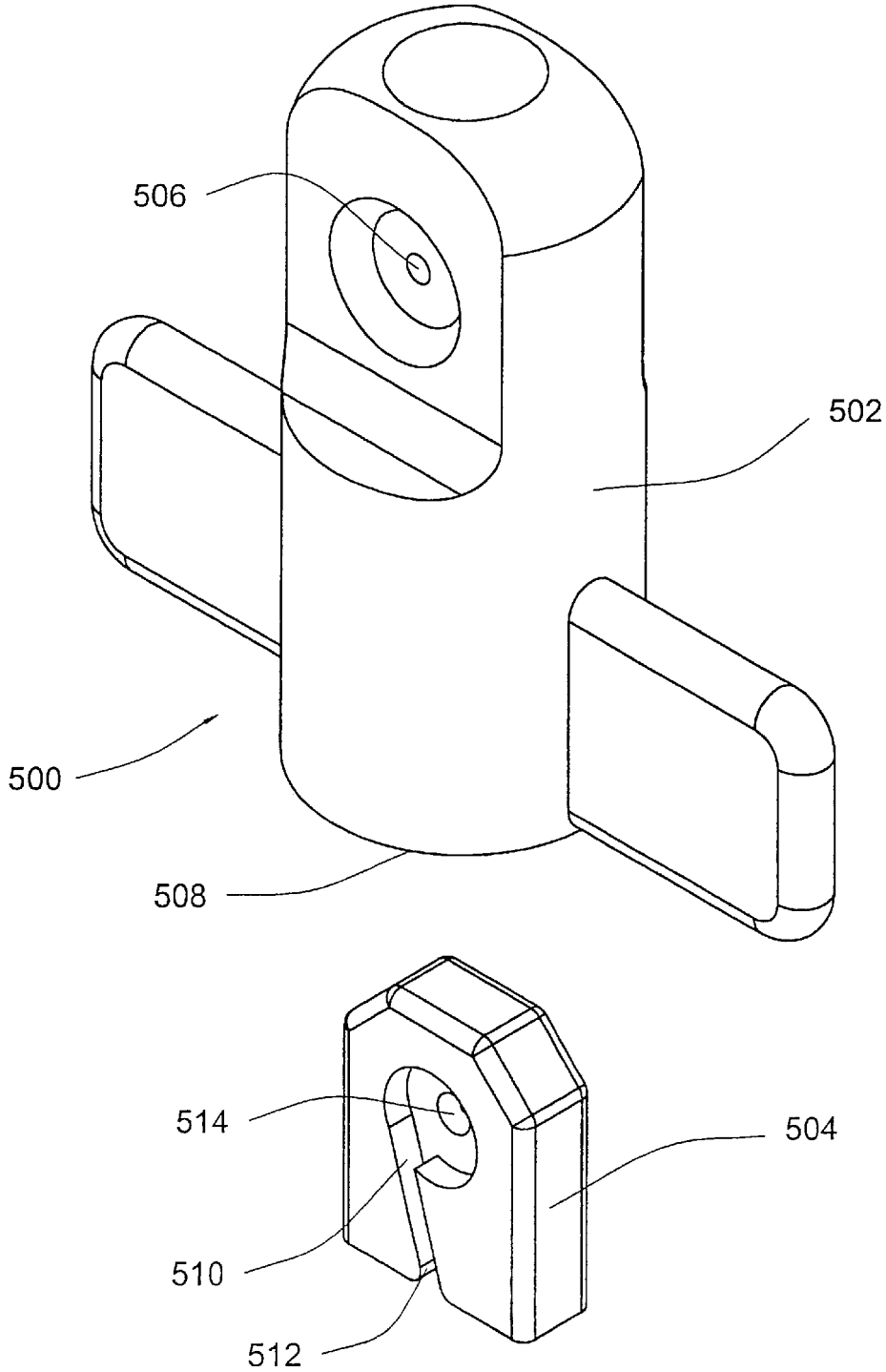
FIG. 12 is an exploded view of an atomizer according to another embodiment of the invention.
Figure 13:
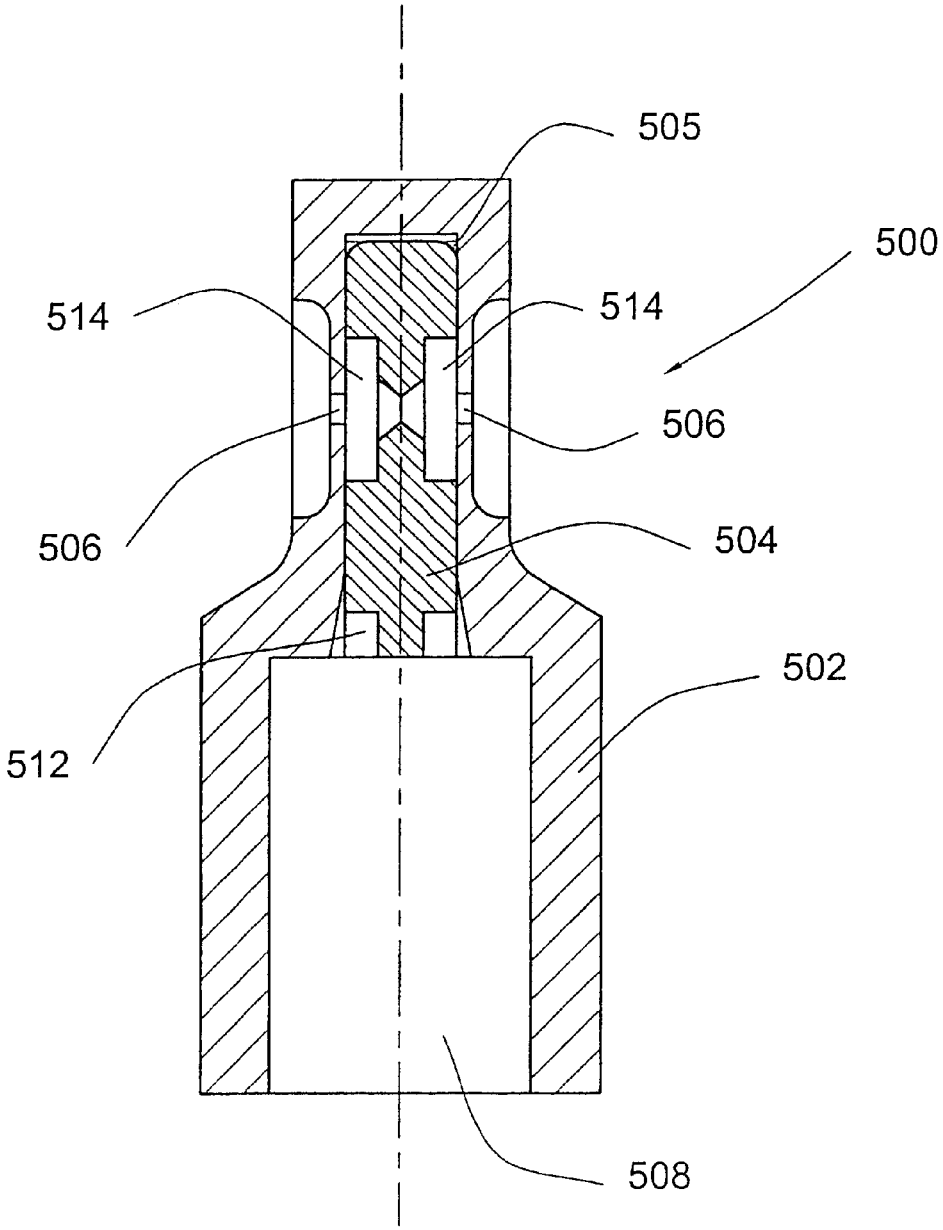
FIG. 13 is a longitudinal section of the atomizer if FIG. 12, in an assembled position.

Further attention is now directed to another embodiment of the invention illustrated in FIGS. 12 and 13. The atomizer generally designated 500 is constructed of a housing 502 and a vortex generating member 504 snugly receivable within a suitable cavity 505 formed in the housing 502 (seen in FIG. 13). Similar to the previous embodiments, the housing 502 is formed with two outlet nozzles 506 extending from the cavity 505, which is in flow communication with an inlet 508 attachable to a water supply. The vortex generating member 504 is adapted for press fitting within the cavity 505 and is formed with two formed with two vortex generating paths 510 (FIG. 12), each extending between an inlet 512 and a vortex generating portion 514, which at the assembled state of the device extends opposite a corresponding outlet nozzle 506 of the housing 502. The arrangement is such that liquid entering inlet 508 flows via inlets 512 into the vortex generating paths 510 such that it is forced to swivel within the vortex generating portion 514, whereby as it leaves the outlets 506 it is in atomized form.

It is appreciated that the embodiment illustrated with reference to FIGS. 12 and 13 may be modified into different embodiments, some of which have been discussed in connection with previous embodiments herein before.

Whilst preferred embodiments have been shown and described, it is to be understood that it is not intended thereby to limit the disclosure of the invention, but rather it is intended to cover all modifications and arrangements falling within the spirit and the scope of the invention, *mutatis mutandis*.

What is claimed is:

1. A liquid atomizer comprising a housing fitted with an inlet for connecting to a liquid supply line and a cavity being in flow communication with the inlet, said cavity having a longitudinal axis;

the housing being formed with at least one outlet nozzle for emitting atomized liquid;

a vortex generating member received within the housing and integrally formed with at least one vortex generating path, each having a vortex generating portion extending opposite a respective outlet nozzle, and being in flow communication with the cavity via a duct portion extending between an inlet to said duct and said vortex generating portion;

said duct encountering said vortex generating portion essentially tangentially;

each of at least one vortex generating path generates a liquid vortex about an axis transversally extending relative to the longitudinal axis of the housing; and wherein the vortex generating path has an R-shaped cross-section with the center of the round portion extending opposite the respective outlet nozzle.

2. A liquid atomizer comprising a housing fitted with an inlet for connecting to a liquid supply line and a cavity being in flow communication with the inlet, said cavity having a longitudinal axis;

the housing having at least one outlet nozzle for emitting atomized liquid;

a vortex-generating member received within the housing and integrally formed with at least one vortex generating path extending opposite a respective outlet nozzle;

each of the at least one vortex generating paths is in flow communication with the cavity and extends opposite the respective outlet nozzle; and each of at least one vortex generating path generates a liquid vortex about an axis transversally extending relative to the longitudinal axis of the housing, wherein the vortex generating member comprises a plurality of vortex generating paths and the housing comprises a plurality of outlet nozzles; the vortex generating paths and the outlet nozzles being distributed at different angular divisions; the vortex generating member is fixable within the housing at different radial positions, each giving rise to cooperation of different outlet nozzles with respective vortex generating paths and to sealing of other outlet nozzles.

3. A liquid atomizer according to claim 2, wherein the housing and vortex generating member are fitted with corresponding mating members for setting the vortex generating member at the different radial positions within the housing.

4. A liquid atomizer comprising a housing fitted with an inlet for connecting to a liquid supply line and a cavity being in flow communication with the inlet, said cavity having a longitudinal axis;

the housing being formed with at least one outlet nozzle for emitting atomized liquid;

a vortex generating member received within the housing and integrally formed with at least one vortex generating path, each having a vortex generating portion extending opposite a respective outlet nozzle, and being in flow communication with the cavity via a duct portion extending between an inlet to said duct and said vortex generating portion;

said duct encountering said vortex generating portion essentially tangentially;

each of at least one vortex-generating path generates a liquid vortex about an axis transversally extending relative to the longitudinal axis of the housing;

wherein the inlet is in flow communication with a pressure threshold valve, and wherein the pressure threshold valve is a leakage preventing device (LPD), and wherein the closure member is spring biased against the inlet of the housing and has a piston rod connecting it with a piston, said piston being displaceable along a corresponding cylinder and being in flow communication with the cavity.

5. A liquid atomizer comprising a housing fitted with an inlet for connecting to a liquid supply line and a cavity being in flow communication with the inlet, said cavity having a longitudinal axis;

the housing having at least one outlet nozzle for emitting atomized liquid;

a vortex-generating member received within the housing and integrally formed with at least one vortex generating path extending opposite a respective outlet nozzle;

each of the at least one vortex generating paths is in flow communication with the cavity and extends opposite the respective outlet nozzle; and each of at least one vortex generating path generates a liquid vortex about an axis transversally extending relative to the longitudinal axis of the housing, wherein the inlet is in flow communication with a pressure threshold valve received within the cavity, wherein the pressure threshold valve comprises a closure member biased against the inlet of the housing, and wherein the cylinder is vented.

6. A liquid atomizer comprising a housing fitted with an inlet for connecting to a liquid supply line and a cavity being in flow communication with the inlet, said cavity having a longitudinal axis;

the housing being formed with at least one outlet nozzle for emitting atomized liquid;

a vortex generating member received within the housing and integrally formed with at least one vortex generating path, each having a vortex generating portion extending opposite a respective outlet nozzle, and being in flow communication with the cavity via a duct portion extending between an inlet to said duct and said vortex generating portion;

said duct encountering said vortex generating portion essentially tangentially; and each of at least one vortex generating path generates a liquid vortex about an axis transversally extending relative to the longitudinal axis of the housing, wherein the inlet is in flow communication with a pressure threshold valve;

wherein the pressure threshold valve is received within the cavity; and wherein the inlet is sealed by a resilient sealing portion associated with the closure member.

7. A liquid atomizer comprising a housing fitted with an inlet for connecting to a liquid supply line and a cavity being in flow communication with the inlet, said cavity having a longitudinal axis;

the housing having at least one outlet nozzle for emitting atomized liquid;

a vortex-generating member received within the housing and integrally formed with at least one vortex generating path extending opposite a respective outlet nozzle;

each of the at least one vortex generating paths is in flow communication with the cavity and extends opposite the respective outlet nozzle; and each of at least one vortex generating path generates a liquid vortex about an axis transversally extending relative to the longitudinal axis of the housing;

wherein the vortex generating member comprises a plurality of vortex generating paths and the housing comprises a plurality of outlet nozzles; the vortex generating paths and the outlet nozzles being distributed at different angular divisions; the vortex generating member is fixable within the housing at different radial positions, each giving rise to cooperation of different outlet nozzles with respective vortex generating paths and to sealing of other outlet nozzles; and wherein at least one outlet nozzle and at least one vortex generating member are axially offset.

* * * * *

UNITED STATES PATENT AND TRADEMARK OFFICE

CERTIFICATE OF CORRECTION

PATENT NO. : 6,637,673 B1
DATED : October 28, 2003
INVENTOR(S) : Zur et al.

It is certified that error appears in the above-identified patent and that said Letters Patent is hereby corrected as shown below:

Title page,
Item [75], Inventors, delete "De Vires" and insert therefor -- De Vries --.

Signed and Sealed this

Ninth Day of March, 2004

JON W. DUDAS
*Acting Director of the United States Patent and Trademark Office*